US010978816B2

(12) United States Patent
Yoshida

(10) Patent No.: US 10,978,816 B2
(45) Date of Patent: Apr. 13, 2021

(54) PRESS-FIT TERMINAL AND TERMINAL-ATTACHED SUBSTRATE

(71) Applicant: Yazaki Corporation, Tokyo (JP)

(72) Inventor: Taisei Yoshida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/726,823

(22) Filed: Dec. 25, 2019

(65) Prior Publication Data

US 2020/0251836 A1 Aug. 6, 2020

(30) Foreign Application Priority Data

Jan. 31, 2019 (JP) ..... JP2019-015285

(51) Int. Cl.
*H01R 12/58* (2011.01)

(52) U.S. Cl.
CPC ..... *H01R 12/58* (2013.01); *H01R 12/585* (2013.01)

(58) Field of Classification Search
CPC .... H01R 12/585; H01R 12/716; H01R 13/41; H01R 13/415; H01R 12/58; H01R 13/05; H01R 13/20; H01R 13/22; H01R 13/2457; H05K 2201/1059
See application file for complete search history.

(56) References Cited

U.S. PATENT DOCUMENTS

| | | | | | |
|---|---|---|---|---|---|
| 4,923,414 | A * | 5/1990 | Sitzler | H01R 12/585 | 439/751 |
| 5,564,954 | A * | 10/1996 | Wurster | H01R 12/585 | 439/751 |
| 5,944,538 | A * | 8/1999 | Sorig | H01R 12/585 | 439/82 |
| 6,077,128 | A * | 6/2000 | Maag | H01R 12/585 | 439/751 |
| 7,008,272 | B2 * | 3/2006 | Blossfeld | H01R 12/585 | 439/751 |
| 10,096,917 | B1 * | 10/2018 | Myer | H01R 12/585 | |
| 10,547,128 | B1 * | 1/2020 | Lin | H01R 12/58 | |
| 2008/0166928 | A1 | 7/2008 | Tang | | |
| 2013/0034976 | A1 | 2/2013 | Tonosaki | | |
| 2020/0119471 | A1 | 4/2020 | Tatsumi et al. | | |

FOREIGN PATENT DOCUMENTS

| | | | |
|---|---|---|---|
| EP | 3091616 | A1 | 11/2016 |
| JP | 2008-53082 | A | 3/2008 |
| JP | 2013-37791 | A | 2/2013 |
| WO | 2018/220927 | A1 | 12/2018 |

* cited by examiner

*Primary Examiner* — Roshn K Varghese
(74) *Attorney, Agent, or Firm* — Kenealy Vaidya LLP

(57) ABSTRACT

A press-fit terminal includes: a pair of press fitting parts that are positioned facing each other in a direction (first orthogonal direction) orthogonal to an insertion direction into a through-hole of a substrate while an axial center along the insertion direction is interposed between the pair of press fitting parts and that are fitted by pressing into the through-hole in the insertion direction; and a compliant part positioned between the pair of press fitting parts and having an open hole that allows the pair of press fitting parts to deform inward in the orthogonal direction.

8 Claims, 5 Drawing Sheets

PRESS-FIT TERMINAL AND TERMINAL-ATTACHED SUBSTRATE

CROSS-REFERENCE TO RELATED APPLICATION(S)

The present application claims priority to and incorporates by reference the entire contents of Japanese Patent Application No. 2019-015285 filed in Japan on Jan. 31, 2019.

BACKGROUND OF THE INVENTION

1. Field of the Invention

The present invention relates to a press-fit terminal and a terminal-attached substrate.

2. Description of the Related Art

Japanese Patent Application Laid-open No. 2008-53082 discloses, as a conventional press-fit terminal, a press-fit terminal having a configuration as follows, for example. The press-fit terminal includes a terminal base part that is fixed when fitted by pressing into a press fitting hole provided to a connector housing, and an elastic deformation part extending from the terminal base part to a circuit board. The elastic deformation part includes an elastic deformation leg, and a slit and an auxiliary slit formed surrounding the leg. The auxiliary slit extends a deformation space downward from the lower end of the slit to allow further downward movement of a fixed end of deflection deformation. The elastic deformation leg includes a taper part having a straight line shape at part of the outer edge, and when insertion is started, the taper part contacts an opening edge of the press fitting hole.

The above-described press-fit terminal has room for improvement in prevention of excessive force application to a substrate.

SUMMARY OF THE INVENTION

The present invention is intended to solve the above-described problem and provide a press-fit terminal and a terminal-attached substrate that can prevent excessive force application to a substrate.

A press-fit terminal according to one aspect of the present invention includes a pair of press fitting parts that are positioned facing each other in a direction orthogonal to an insertion direction into a through-hole of a substrate while an axial center along the insertion direction is interposed between the pair of press fitting parts, the press fitting parts being fitted by pressing into the through-hole in the insertion direction; and a compliant part positioned between the pair of press fitting parts and having an open hole that allows the pair of press fitting parts to deform inward in the orthogonal direction, wherein the compliant part includes a rigid body part that is positioned at a base end opposite to a leading end side of the open hole in the insertion direction and at which the pair of press fitting parts intersect each other, and the rigid body part includes, on an outer surface in the orthogonal direction, a curved concave part formed in a concave curve toward the axial center.

According to another aspect of the present invention, in the press-fit terminal, it is preferable that the pair of press fitting parts have inner wall surfaces, respectively, positioned on the open hole side in the orthogonal direction and facing each other, and the inner wall surface includes, at an end part of the rigid body part in the insertion direction, a curved convex part formed in a convex curve toward the axial center.

A terminal-attached substrate according to still another aspect of the present invention includes a substrate having a through-hole; and a press-fit terminal fitted by pressing to the through-hole, wherein the press-fit terminal includes a pair of press fitting parts that are positioned facing each other in a direction orthogonal to an insertion direction into the through-hole of the substrate while an axial center along the insertion direction is interposed between the pair of press fitting parts and that are fitted by pressing into the through-hole in the insertion direction, and a compliant part positioned between the pair of press fitting parts and having an open hole that allows the pair of press fitting parts to deform inward in the orthogonal direction, the compliant part includes a rigid body part that is positioned at a base end opposite to a leading end side of the open hole in the insertion direction and at which the pair of press fitting parts intersect each other, the rigid body part includes, on an outer surface in the orthogonal direction, a curved concave part formed in a concave curve toward the axial center, and a space due to the curved concave part is formed between an inner peripheral surface of the through-hole of the substrate and the outer surface of the rigid body part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a press-fit terminal and a terminal-attached substrate according to the present invention will be described below with reference to the accompanying drawings. The present invention is not limited by the present embodiment.

Figure 1:
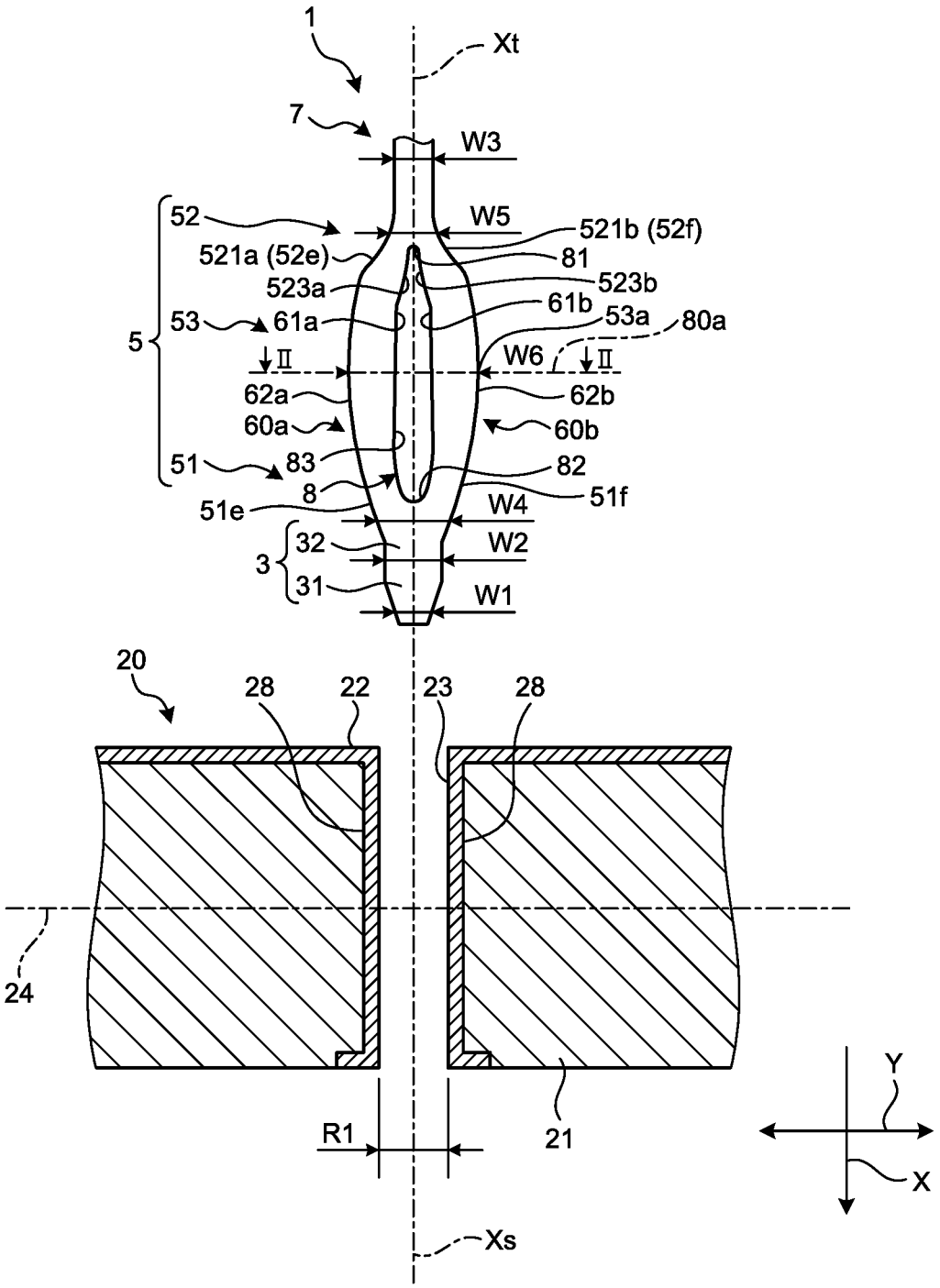
FIG. 1 is a front view of a press-fit terminal according to the present invention.
Figure 2:
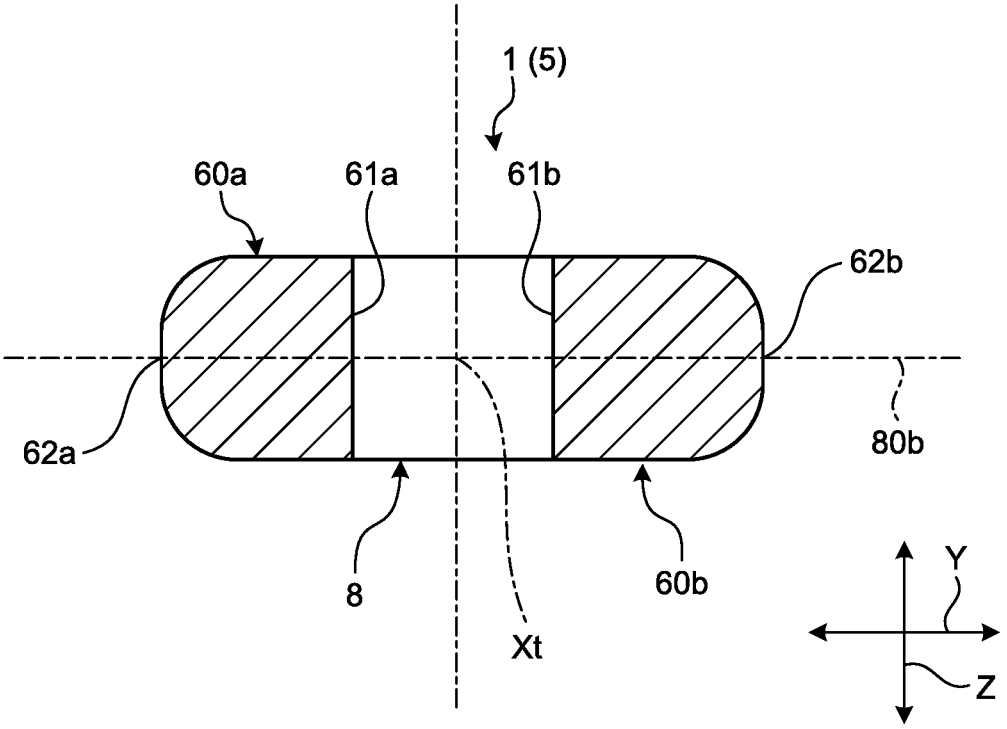
FIG. 2 is a cross-sectional view in the direction of arrow II-II in FIG. 1.
Figure 3:
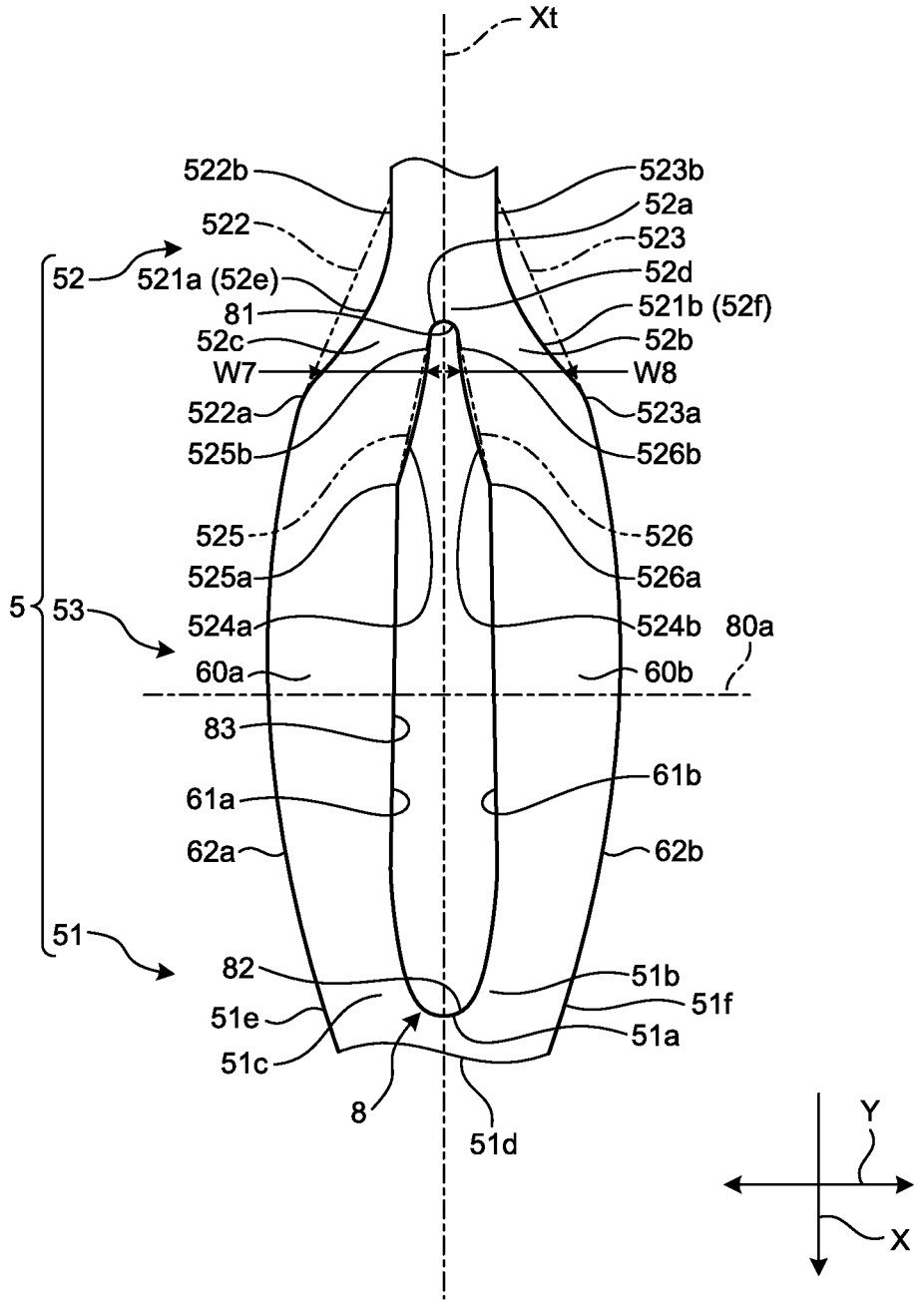
FIG. 3 is a partially enlarged diagram of a compliant part of the press-fit terminal.
Figure 4:
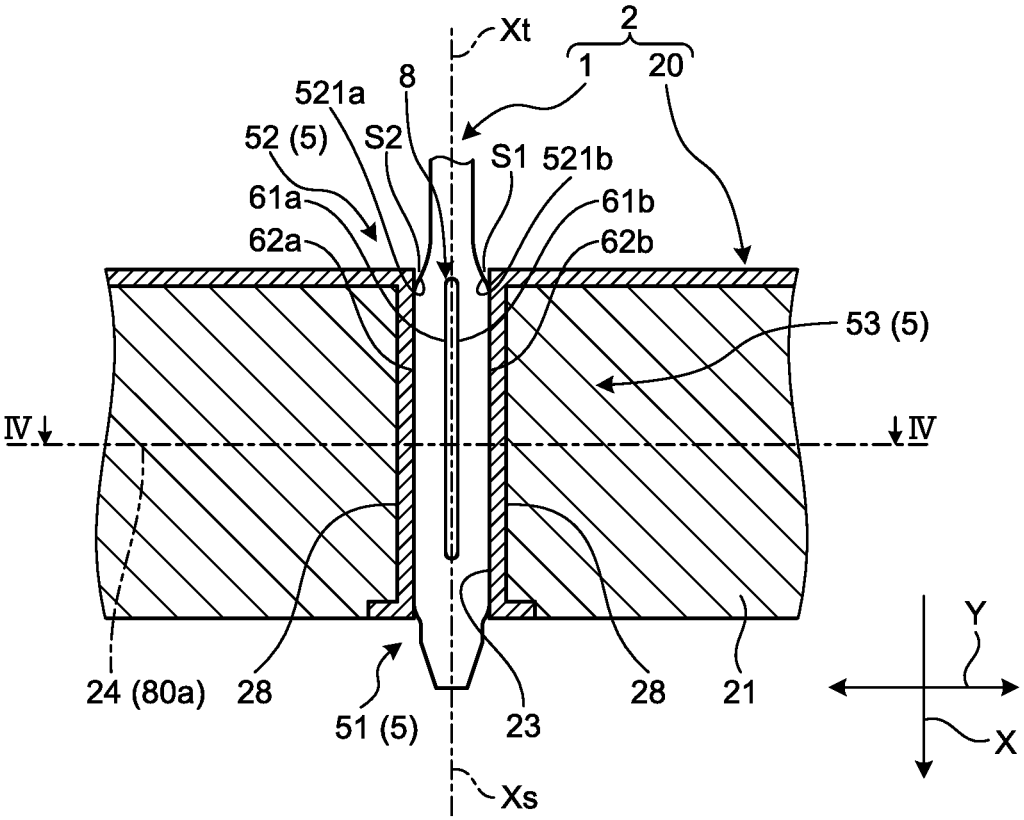
FIG. 4 is a front view illustrating a state in which the compliant part of the press-fit terminal is fitted by pressing in a through-hole of a substrate.
Figure 5:
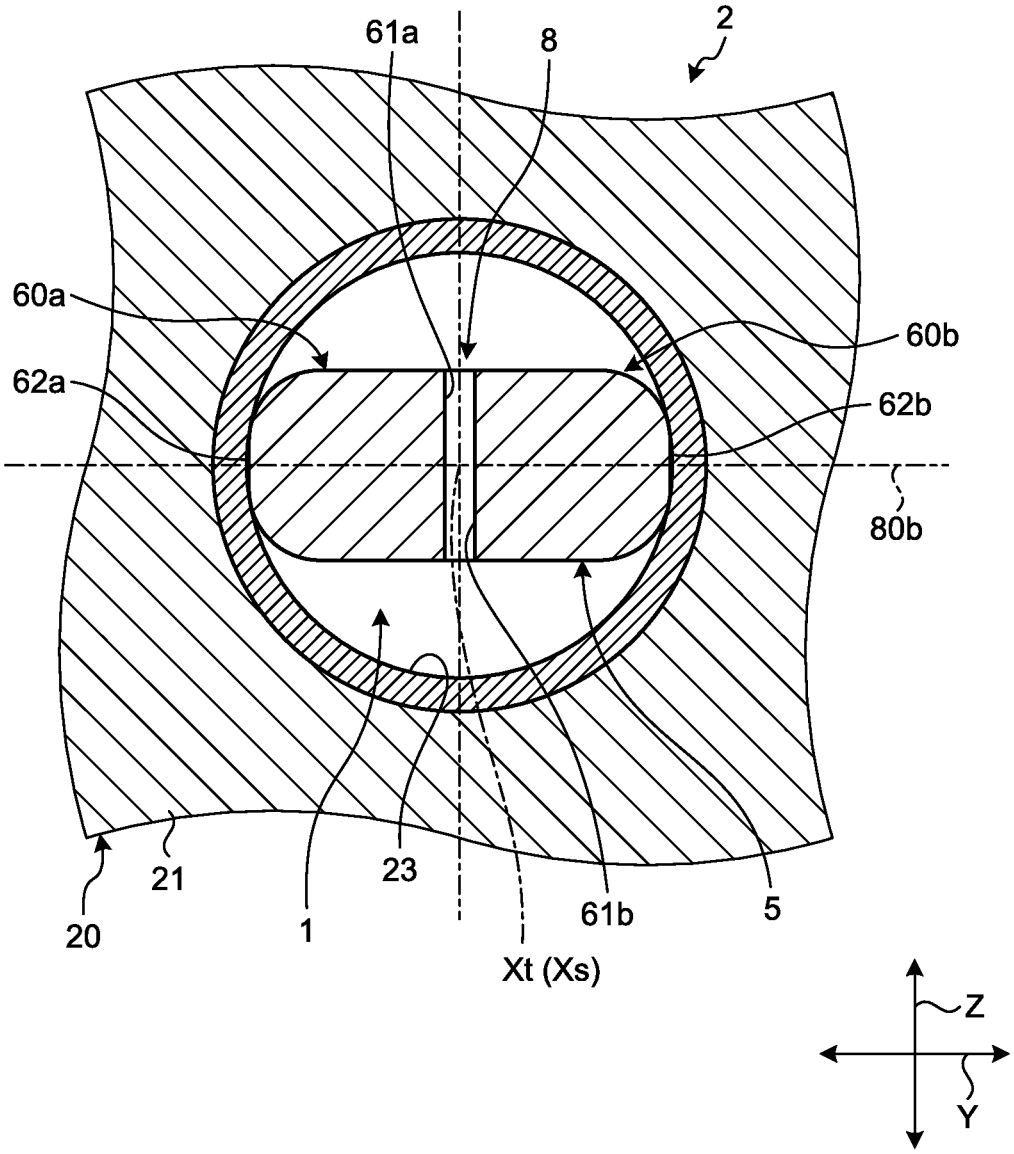
FIG. 5 is a cross-sectional view in the direction of arrow IV-IV in FIG. 4.

FIG. 1 is a front view of a press-fit terminal according to the present invention. FIG. 2 is a cross-sectional view in the direction of arrow II-II in FIG. 1. FIG. 3 is a partially enlarged diagram of the press-fit terminal. FIG. 4 is a front view illustrating a state in which a compliant part of the press-fit terminal is fitted by pressing in a through-hole of a substrate. FIG. 5 is a cross-sectional view in the direction of arrow IV-IV in FIG. 4.

As illustrated in FIG. 1, an X direction is defined to be the insertion direction of a press-fit terminal 1 into a through-hole 23 of a substrate 20 in the present embodiment. As illustrated in FIG. 1, a Y direction is defined to be a first orthogonal direction (orthogonal direction) of the press-fit terminal 1 orthogonal to the insertion direction X. As illustrated in FIG. 2, a Z direction is defined to be a second orthogonal direction of the press-fit terminal 1 orthogonal to each of the insertion direction X and the first orthogonal direction Y. In the present specification, the press-fit terminal 1 has a leading end in the insertion direction X, and a base end opposite to the leading end side in the insertion direction X.

The press-fit terminal 1 according to the present embodiment is used for, for example, the substrate 20 such as a printed substrate. As illustrated in FIG. 1, the substrate 20 includes an electrically insulating substrate body 21. The substrate body 21 includes an electrically conductive circuit unit 22, and the through-hole 23 electrically connected with the circuit unit 22. The circuit unit 22 is disposed on, for example, one surface (mounting surface) of the substrate 20 in the insertion direction X. The through-hole 23 is formed to penetrate through the substrate body 21 in the insertion direction X, for example, in a cylindrical shape having a penetration axis Xs. The through-hole 23 is formed to have a diameter R1 that is constant in the insertion direction X. The inner peripheral surface of the through-hole 23 is covered by a conductive part 28 made of an electrically conductive material. The press-fit terminal 1 and the substrate 20 form a terminal-attached substrate 2 (refer to FIG. 4). In other words, the terminal-attached substrate 2 includes the press-fit terminal 1 and the substrate 20.

As illustrated in, for example, FIG. 1 the press-fit terminal 1 includes an axial center Xt made of an electrically conductive material such as copper alloy and extending along the insertion direction X of the substrate 20, and also includes a leading end part 3, a compliant part 5, and a base end part 7. The press-fit terminal 1 is formed to extend in the insertion direction X and connected with, at the leading end part as an end part on one side (leading end side) in the insertion direction X, the substrate 20 through the compliant part 5 and the like, and with a connection object (target electrically connected with the substrate 20) at the base end part as an end part on the other side (base end side). A plating layer may be formed on the surface of such a press-fit terminal 1 by tin plating, silver plating, gold plating, or the like. The press-fit terminal 1 is formed substantially line symmetric with respect to the axial center Xt.

The leading end part 3 is positioned on the most leading end side of the press-fit terminal 1 and includes a first part 31 and a second part 32. The first part 31 extends in a direction opposite to the insertion direction X and has a width dimension W1 that gradually increases from the leading end side to the base end side. The second part 32 is positioned on the base end side of the first part 31, extends in the insertion direction X, and has a width dimension W2 that is constant in the first orthogonal direction Y. The width dimension W1 of the first part 31 in the first orthogonal direction Y and the width dimension W2 of the second part 32 in the first orthogonal direction Y are smaller than the diameter R1 of the through-hole 23. Thus, the leading end part 3 can be inserted into the through-hole 23.

The base end part 7 is positioned nearest to the base end of the press-fit terminal 1 and formed to extend in the insertion direction X and have a width dimension W3 in the first orthogonal direction Y that is constant in the insertion direction X.

The compliant part 5 is disposed adjacent to the base end side of the leading end part 3 and the leading end side of the base end part 7 in the insertion direction X. The width dimension of the compliant part 5 in the first orthogonal direction Y is larger than the width dimensions W1 and W2 of the leading end part 3 in the first orthogonal direction Y and larger than the width dimension W3 of the base end part 7 in the first orthogonal direction Y. The compliant part is fitted by pressing into the through-hole 23.

The compliant part 5 includes, in the insertion direction X, an introduction part 51 positioned on the leading end side, a rigid body part 52 positioned on the base end side, and a central part 53 positioned between the introduction part 51 and the rigid body part 52, and also has an open hole 8 positioned at the center in the first orthogonal direction Y and extending in the insertion direction X. The compliant part 5 is bifurcated into two parts due to the above-described open hole 8. Accordingly, in the compliant part 5, the open hole 8 is positioned at the center in the insertion direction, and a pair of press fitting parts 60*a* and 60*b* are disposed on one and the other sides, respectively, of the open hole 8 in the first orthogonal direction Y. The pair of press fitting parts 60*a* and 60*b* are each a part extending in a column shape in the insertion direction X and formed in a curve protruding toward a side (in other words, outward in the first orthogonal direction Y) opposite to the open hole 8 in the first orthogonal direction Y. The pair of press fitting parts 60*a* and 60*b* are positioned facing each other in the first orthogonal direction Y. In other words, in the pair of press fitting parts 60*a* and 60*b*, the one press fitting part 60*a* and the other press fitting part 60*b* face each other in the first orthogonal direction Y. The pair of press fitting parts 60*a* and 60*b* are fitted by pressing into the through-hole 23 in the insertion direction X.

The introduction part 51 is disposed adjacent to the leading end part 3 and has a width dimension W4 in the first orthogonal direction Y that gradually increases from the leading end side toward the base end side.

The rigid body part 52 is disposed adjacent to the base end part 7 and has a width dimension W5 in the first orthogonal direction Y that gradually increases from the base end side toward the leading end side.

The central part 53 includes a wide part 53*a* having a largest width dimension W6 in the first orthogonal direction Y in the press-fit terminal 1. The width dimension in the first orthogonal direction Y gradually decreases from the wide part 53*a* in the insertion direction X and the direction opposite to the insertion direction X. The central part 53 in the first orthogonal direction Y has a width dimension slightly larger than the diameter R1 of the through-hole 23.

The open hole 8 has a substantially oval shape longitudinally elongated in the insertion direction X in the front view, and is formed to penetrate through the compliant part 5 in the second orthogonal direction Z as illustrated in FIG. 2. The open hole 8 is positioned between the pair of press fitting parts 60*a* and 60*b* in the first orthogonal direction Y, and allows the pair of press fitting parts 60*a* and 60*b* to deform inward in the first orthogonal direction Y.

As illustrated in FIG. 1, the open hole 8 includes, in the insertion direction X, a base end portion 81 positioned at the base end in the insertion direction X, a leading end portion 82 positioned at the leading end in the insertion direction X, and a central part 83 positioned between the base end portion 81 and the leading end portion 82. The base end portion 81 is formed in a semicircular shape having a width dimension in the first orthogonal direction Y that gradually increases in the insertion direction X. The leading end portion 82 is formed in a semicircular shape having a width dimension in the first orthogonal direction Y that gradually increases in the direction opposite to the insertion direction X. The central part 83 is formed to have a width dimension on the leading end side that gradually decreases as compared to that on the base end side in the direction opposite to the insertion direction X. The central part 83 includes a first central position 80*a* of the open hole 8 in the insertion direction X. The base end portion 81 has a diameter smaller than that of the leading end portion 82.

As illustrated in FIG. 2, the open hole 8 includes a second central position 80*b* in the second orthogonal direction Z, and is formed substantially line symmetric with respect to the second central position 80*b* along a plane including the first orthogonal direction Y and the second orthogonal direction Z.

As illustrated in FIG. 3, the pair of press fitting parts 60*a* and 60*b* include inner wall surfaces 61*a* and 61*b*, respectively, positioned on the open hole 8 side in the first orthogonal direction Y and facing each other. In other words, the press fitting parts 60*a* and 60*b* include the inner wall surfaces 61*a* and 61*b* on the inner side in the first orthogonal direction Y. The press fitting parts 60*a* and 60*b* also include outer wall surfaces 62*a* and 62*b*, respectively, positioned on a side opposite to the open hole 8 in the first orthogonal direction Y. In other words, the press fitting parts 60*a* and 60*b* include the outer wall surfaces 62*a* and 62*b* on the outer side in the first orthogonal direction Y. The inner side in the first orthogonal direction Y is a side adjacent to the open hole 8 in the first orthogonal direction Y and near the axial center Xt. The outer side in the first orthogonal direction Y is a side opposite to the open hole 8 in the first orthogonal direction Y and away from the axial center Xt.

The following describes, in more detail, the introduction part 51, the rigid body part 52, and the central part 53 of the compliant part 5 configured as described above.

The introduction part 51 includes a bifurcation part 51*a*, a pair of base end side parts 51*b* and 51*c*, and a leading end side part 51*d*. The bifurcation part 51*a* is positioned at the leading end of the open hole 8 in the insertion direction X where bifurcation into the pair of press fitting parts 60*a* and 60*b* occurs. The pair of base end side parts 51*b* and 51*c* are parts where the leading end portion 82 of the open hole 8 is formed, and are positioned on the base end side of the bifurcation part 51*a*. The leading end side part 51*d* is positioned on the leading end side of the bifurcation part 51*a* where the open hole 8 is not positioned. In other words, the introduction part 51 is a part positioned at the leading end of the open hole 8 in the insertion direction X where bifurcation into the pair of press fitting parts 60*a* and 60*b* occurs. The introduction part 51 has outer surfaces 51*e* and 51*f* on the outer side in the first orthogonal direction.

The rigid body part 52 includes an intersection part 52*a*, a pair of leading end side parts 52*b* and 52*c*, and a base end side part 52*d*. The intersection part 52*a* is positioned at the base end of the open hole 8 in the insertion direction X where intersection between the pair of press fitting parts 60*a* and 60*b* occurs. The pair of leading end side parts 52*b* and 52*c* are parts where the base end portion 81 of the open hole 8 is formed, and are positioned on the leading end side of the intersection part 52*a*. The base end side part 52*d* is positioned on the base end side of the intersection part 52*a* where the open hole 8 is not positioned. In other words, the rigid body part 52 is a part positioned at the base end opposite to the leading end side of the open hole 8 in the insertion direction X where intersection between the pair of press fitting parts 60*a* and 60*b* occurs. The rigid body part 52 has outer surfaces 52*e* and 52*f* on the outer side in the first orthogonal direction.

The central part 53 is a part where the open hole 8 is formed in the entire range thereof in the insertion direction X, whereas the introduction part 51 includes the leading end side part 51*d* where the open hole 8 is not positioned. Accordingly, the introduction part 51 has stiffness higher than that of the central part 53 in the first orthogonal direction Y. Similarly, the central part 53 is a part where the open hole 8 is formed in the entire range thereof in the insertion direction X, whereas the rigid body part 52 includes the base end side part 52*d* where the open hole 8 is not positioned. Accordingly, the rigid body part 52 has stiffness higher than that of the central part 53 in the first orthogonal direction Y.

The rigid body part 52 according to the present embodiment includes, on the outer surfaces 52*e* and 52*f* in the first orthogonal direction Y, curved concave parts 521*a* and 521*b* formed in concave curves toward the axial center Xt. The curved concave part 521*a* of the one press fitting part 60*a* includes a one end 522*a* and another end 522*b* and is positioned on a side nearer the axial center Xt than a virtual line segment 522 passing through the one end 522*a* and the other end 522*b*. The one end 522*a* is positioned on the leading end side in the insertion direction X. The other end 522*b* is positioned on the base end side opposite to the leading end side in the insertion direction X. The curved concave part 521*b* of the other press fitting part 60*b* includes a one end 523*a* and another end 523*b*, and is positioned on a side nearer the axial center Xt than a virtual line segment 523 passing through the one end 523*a* and the other end 523*b*. The one end 523*a* is positioned on the leading end side in the insertion direction X. The other end 523*b* is positioned on the base end side opposite to the leading end side in the insertion direction X. Such curved concave parts 521*a* and 521*b* are formed only at the rigid body part 52 but not at the introduction part 51. The curved concave parts 521*a* and 521*b* are positioned on the outer side of the base end portion 81 of the open hole 8 in the first orthogonal direction Y. In other words, the base end portion 81 of the open hole 8 is positioned on the inner side of the curved concave parts 521*a* and 521*b* in the first orthogonal direction Y.

The one end 522*a* of the curved concave part 521*a* and the one end 523*a* of the curved concave part 521*b* are positioned between the leading end of the base end portion 81 of the open hole 8 and the first central position 80*a* in the insertion direction X. The other end 522*b* and the other end 523*b* are positioned at the leading end of the base end part 7 in the insertion direction X where the width dimension W3 (refer to FIG. 1) in the first orthogonal direction Y is constant. In other words, the curved concave parts 521*a* and 521*b* are positioned on the outer surfaces 52*e* and 52*f*, respectively, of the rigid body part 52 in the first orthogonal direction Y, and include the one end 522*a* and the one end 523*a*, respectively, positioned between the base end portion 81 and the first central position 80*a* in the insertion direction X, and the other end 522*b* and the other end 523*b* positioned at the leading end of the base end part 7 in the insertion direction X. The curved concave parts 521*a* and 521*b* are curved in concave shapes toward the axial center Xt from the one end 522*a* and the other end 522*b* and from the one end 523*a* and the other end 523*b*, respectively.

The inner wall surfaces 61*a* and 61*b* include curved convex parts 524*a* and 524*b*, respectively, formed in convex curves toward the axial center Xt at an end part of the rigid body part 52 in the insertion direction X. In other words, the inner wall surfaces 61*a* and 61*b* include the curved convex parts 524*a* and 524*b*, respectively, formed in convex curves toward the open hole 8 at the end part of the rigid body part 52 in the insertion direction X. The curved convex part 524*a* of the one press fitting part 60*a* includes a one end 525*a* and another end 525*b*, and is positioned on a side nearer the axial center Xt than a second virtual line segment 525 passing through the one end 525*a* and the other end 525*b*. The one end 525*a* is positioned on the leading end side in the insertion direction X. The other end 525*b* is positioned on the base end side opposite to the leading end side in the insertion direction X. The curved convex part 524*b* of the other press fitting part 60*b* includes a one end 526*a* and another end 526*b*, and is positioned on a side nearer the axial center Xt than a second virtual line segment 526 passing through the one end 526*a* and the other end 526*b*. The one end 526*a* is positioned on the leading end side in the insertion direction X. The other end 526*b* is positioned on the base end side opposite to the leading end side in the insertion direction X.

The one end 525*a* of the curved convex part 524*a* is positioned between the one end 522*a* of the curved concave part 521*a* and the first central position 80*a* in the insertion direction X, and the one end 526*a* of the curved convex part 524*b* is positioned between the one end 523*a* of the curved concave part 521*b* and the first central position 80*a* in the insertion direction X. The other end 525*b* and the other end 526*b* are positioned at the leading end of the base end portion 81 of the open hole 8 in the insertion direction X. In other words, the curved convex part 524*a* is positioned at the end part of the rigid body part 52 in the insertion direction X and includes the one end 525*a* positioned between the one end 522*a* of the curved concave part 521*a* and the first central position 80*a* in the insertion direction X and the other end 525*b* positioned at the leading end of the base end portion 81 of the open hole 8 in the insertion direction X, and the curved convex part 524*b* is positioned at the end part of the rigid body part 52 in the insertion direction X and includes the one end 526*a* positioned between the one end 523*a* of the curved concave part 521*b* and the first central position 80*a* in the insertion direction X and the other end 526*b* positioned at the leading end of the base end portion 81 of the open hole 8 in the insertion direction X. The curved convex parts 524*a* and 524*b* are each curved in a convex shape toward the axial center Xt from the corresponding one of the one end 525*a* and the one end 526*a* and from the corresponding one of the other end 525*b* and the other end 526*b*.

With the curved convex parts 524*a* and 524*b*, the press-fit terminal 1 has increased width dimensions W7 and W8 at the leading end side parts 52*b* and 52*c* of the rigid body part 52 in the first orthogonal direction Y. The curved convex parts 524*a* and 524*b* are positioned on the inner side of the curved concave parts 521*a* and 521*b* in the first orthogonal direction Y. Such curved convex parts 524*a* and 524*b* are formed only at the rigid body part 52 but not at the introduction part 51.

Except for the introduction part 51 and the rigid body part 52, the compliant part 5 configured as described above is formed to be substantially line symmetric with respect to the first central position 80*a* along a plane including the insertion direction X and the first orthogonal direction Y. In comparison between the leading end side and the base end side of the first central position 80*a* in the insertion direction X, the curved concave parts 521*a* and 521*b* are formed at the rigid body part 52 but no curved concave parts 521*a* and 521*b* are formed at the introduction part 51 in the compliant part 5. Accordingly, the outer surfaces 51*e* and 51*f* of the introduction part 51 are positioned on the outer side of the curved concave parts 521*a* and 521*b* of the rigid body part 52 in the first orthogonal direction Y. In other words, the curved concave parts 521*a* and 521*b* of the rigid body part 52 are positioned on the inner side of the outer surfaces 51*e* and 51*f* of the introduction part 51 in the first orthogonal direction Y. In addition, the inner wall surfaces 61*a* and 61*b* of the introduction part 51 are positioned on the outer side of the curved convex parts 524*a* and 524*b* of the rigid body part 52 in the first orthogonal direction Y. In other words, the curved convex parts 524*a* and 524*b* of the rigid body part 52 are positioned on the inner side of the inner wall surfaces 61*a* and 61*b* of the introduction part 51 in the first orthogonal direction Y.

When such a press-fit terminal 1 is attached to the substrate 20, a worker first aligns the penetration axis Xs of the through-hole 23 and the axial center Xt of the press-fit terminal 1 with each other as illustrated in FIG. 1. Subsequently, the worker inserts the leading end part 3 into the through-hole 23.

The width dimension of the central part 53 of the press-fit terminal 1 in the first orthogonal direction Y is slightly larger than the diameter R1 of the through-hole 23 in the first orthogonal direction Y. Thus, as the worker inserts the press-fit terminal 1 into the through-hole 23 in the insertion direction X, the outer wall surfaces 62*a* and 62*b* of the press fitting parts 60*a* and 60*b* of the central part 53 contact the inner peripheral surface of the through-hole 23.

Thereafter, as the worker inserts the compliant part 5 further into the through-hole 23 in the insertion direction X, the press fitting parts 60*a* and 60*b* of the compliant part 5 deform so that the compliant part 5 is fitted by pressing into the through-hole 23. More specifically, as illustrated in FIGS. 4 and 5, the inner wall surfaces 61*a* and 61*b* of the pair of press fitting parts 60*a* and 60*b* deform closer to each other in the first orthogonal direction Y, and the width dimension of the open hole 8 in the first orthogonal direction Y decreases. As illustrated in FIG. 4, the worker fits by pressing the compliant part 5 to the through-hole 23 up to a position where the first central position 80*a* of the open hole 8 and a central position 24 of the through-hole 23 in the insertion direction X coincide with each other, which ends attachment of the press-fit terminal 1 to the substrate 20.

While being fitted by pressing to the through-hole 23, the terminal-attached substrate 2 is positioned between the inner peripheral surface of the through-hole 23 of the substrate 20 and each of the outer surfaces 52*e* and 52*f* of the rigid body part 52, and has spaces S1 and S2 formed by the curved concave parts 521*a* and 521*b*.

The press-fit terminal 1 and the terminal-attached substrate 2 according to the present embodiment include the rigid body part 52 configured as follows. As illustrated in FIG. 3, the rigid body part 52 includes, on the outer surfaces 52*e* and 52*f* in the first orthogonal direction Y, the curved concave parts 521*a* and 521*b* formed in concave curves toward the axial center Xt. In the press-fit terminal 1, the curved concave part 521*a* or 521*b* forms the space S1 or S2 between the outer surface 52*e* or 52*f* of the rigid body part 52 and the inner peripheral surface of the through-hole 23, respectively, while the rigid body part 52 is fitted by pressing to the through-hole 23. Thus, the outer surfaces 52*e* and 52*f* of the rigid body part 52 can be prevented from contacting the inner peripheral surface of the through-hole 23, and accordingly, the press-fit terminal 1 can prevent excessive force application to the substrate 20 due to contact of the outer surfaces 52*e* and 52*f* of the rigid body part 52 with the inner peripheral surface of the through-hole 23.

When the rigid body part 52 is positioned inside the through-hole 23 while the press-fit terminal 1 is fitted by pressing to the through-hole 23, the curved concave parts 521*a* and 521*b* prevent the outer surfaces 52*e* and 52*f* of the rigid body part 52 from contacting the inner peripheral surface of the through-hole 23, and thus excessive force is not applied to the substrate 20. In addition, when the rigid body part 52 is positioned outside the through-hole 23 while the press-fit terminal 1 is fitted by pressing to the through-hole 23, the outer surfaces 52*e* and 52*f* of the rigid body part 52 do not contact the inner peripheral surface of the through-hole 23, and thus excessive force is not applied to the substrate 20. Accordingly, the press-fit terminal 1 prevents excessive force application to the substrate 20 whether the rigid body part 52 is positioned inside or outside the through-hole 23, and thus it is possible to increase a tolerance that allows shift of the position of the rigid body part 52 relative to the substrate 20 in the insertion direction X. As a result, the press-fit terminal 1 can be easily manufactured.

In the press-fit terminal 1, since no curved concave parts 521*a* and 521*b* are formed on the outer surfaces 51*e* and 51*f* of the introduction part 51, the outer surfaces 51*e* and 51*f* of the introduction part 51 can contact the inner peripheral surface of the through-hole 23. Thus, in the press-fit terminal 1, a range on the leading end side in which a contact point for electrical connection with the substrate 20 can be formed is increased as compared to the base end side in the insertion direction X. As a result, in the press-fit terminal 1, a dimension in the insertion direction X in which a contact point for electrical connection with the substrate 20 can be formed is increased, and thus electrical connection with the substrate 20 can be reliably performed.

The inner wall surfaces 61*a* and 61*b* of the press-fit terminal 1 include the curved convex parts 524*a* and 524*b* formed in convex curves toward the axial center Xt at the end part of the rigid body part 52 in the insertion direction X. In the press-fit terminal 1, the width dimensions W7 and W8 in the first orthogonal direction Y at the leading end side parts 52*b* and 52*c* of the rigid body part 52 are increased due to the curved convex parts 524*a* and 524*b*. Thus, the stiffness of the leading end side parts 52*b* and 52*c* of the rigid body part 52 in the first orthogonal direction Y when the curved concave parts 521*a* and 521*b* are formed at the rigid body part 52 is maintained relatively high to ensure the strength of the leading end side parts 52*b* and 52*c* of the rigid body part 52.

The curved convex parts 524*a* and 524*b* of the press-fit terminal 1 extend in the insertion direction X beyond the one end 522*a* of the curved concave part 521*a* and the one end 523*a* of the curved concave part 521*b* in the insertion direction X. Thus, in the press-fit terminal 1, the stiffness of the leading end side parts 52*b* and 52*c* of the rigid body part 52 in the first orthogonal direction Y when the curved concave parts 521*a* and 521*b* are formed at the rigid body part 52 is increased due to the curved convex parts 524*a* and 524*b*. Accordingly, the press-fit terminal 1 reliably ensures the strength of the leading end side parts 52*b* and 52*c* of the rigid body part 52.

In the open hole 8 of the press-fit terminal 1, the diameter of the base end portion 81 positioned at the base end in the insertion direction X is smaller than the diameter of the leading end portion 82 positioned at the leading end in the insertion direction X, and the base end portion 81 of the open hole 8 is positioned on the inner side of the curved concave parts 521*a* and 521*b* in the first orthogonal direction Y. Thus, in the press-fit terminal 1, the width dimension in the first orthogonal direction Y at the leading end side parts 52*b* and 52*c* of the rigid body part 52 is increased due to the base end portion 81 of the open hole 8. As a result, in the press-fit terminal 1, the stiffness of the leading end side parts 52*b* and 52*c* of the rigid body part 52 in the first orthogonal direction Y when the curved concave parts 521*a* and 521*b* are formed at the rigid body part 52 is further increased. Accordingly, the press-fit terminal 1 more reliably ensures the strength of the leading end side parts 52*b* and 52*c* of the rigid body part 52.

The press-fit terminal 1 described above in the embodiment includes the open hole 8 having a substantially oval elongated shape extending in the insertion direction X in a front view. However, the present invention is not limited thereto, and the open hole 8 may have another shape.

In the press-fit terminal 1 described above in the embodiment, the pair of curved concave parts 521*a* and 521*b* are formed substantially line symmetric with respect to the axial center Xt at the rigid body part 52. However, the present invention is not limited thereto, and only one of the pair of curved concave parts 521*a* and 521*b* may be formed at the rigid body part 52 in the press-fit terminal 1.

In the press-fit terminal 1 described above in the embodiment, the pair of curved convex parts 524*a* and 524*b* are formed substantially line symmetric with respect to the axial center Xt on the inner wall surfaces 61*a* and 61*b* of the rigid body part 52. However, the present invention is not limited thereto, and only one of the pair of curved convex parts 524*a* and 524*b* may be formed on the inner wall surface 61*a* or 61*b* of the rigid body part 52 in the press-fit terminal 1.

A press-fit terminal and a terminal-attached substrate according to the present embodiment have configurations as follows. A rigid body part has, on an outer surface in an orthogonal direction, a curved concave part formed in a concave curve toward an axial center. The press-fit terminal has a space formed due to the curved concave part between the outer surface of the rigid body part and an inner peripheral surface of a through-hole, thereby preventing contact between the outer surface of the rigid body part and the inner peripheral surface of the through-hole. Accordingly, the press-fit terminal can prevent excessive force application to a substrate due to contact between the outer surface of the rigid body part and the inner peripheral surface of the through-hole.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A press-fit terminal comprising:

a pair of press fitting parts that are positioned facing each other in a direction orthogonal to an insertion direction into a through-hole of a substrate while an axial center along the insertion direction is interposed between the pair of press fitting parts, the press fitting parts being fitted by pressing into the through-hole in the insertion direction;

a compliant part positioned between the pair of press fitting parts and having an open hole that allows the pair of press fitting parts to deform inward in the orthogonal direction; and a base end part adjacent to the compliant part and extending away from the compliant part in an opposite direction that is opposite to the insertion direction, wherein the compliant part includes a rigid body part that is positioned at a base end opposite to a leading end side of the open hole in the insertion direction such that the pair of press fitting parts intersect each other at an end part of the rigid body part, the rigid body part includes, on an outer surface in the orthogonal direction, a curved concave part formed in a concave curve toward the axial center, the pair of press fitting parts have inner wall surfaces, respectively, positioned on the open hole in the orthogonal direction and facing each other, each of the inner wall surfaces includes, at the end part of the rigid body part in the insertion direction, a curved convex part formed in a convex curve toward the axial center, the curved concave part and the curved convex part overlap each other in the orthogonal direction at the base end, the compliant part extends along a first length in the opposite direction and includes a variable first width measured in the orthogonal direction that varies along the first length between a largest width and a smallest width, the base end part extends along a second length in the opposite direction and includes a second width measured in the orthogonal direction, the second width is constant along the second length, and the second width is smaller than the largest width of the variable first width.

2. The press-fit terminal according to claim 1, wherein the rigid body part includes a pair of leading end side parts located where the base end and the open hole are formed, and the curved concave part and the convex curve overlap each other along the pair of leading end side parts of the rigid body part.

3. The press-fit terminal according to claim 1, wherein the base end has a base end part that extends in the insertion direction and has a first width dimension, the rigid body part is adjacent the base end part and the rigid body part has a second width dimension, and the second width dimension is greater than the first width dimension.

4. The press-fit terminal according to claim 1, wherein the open hole includes a base end side that is adjacent to the convex curved part and has a first diameter, the leading end side of the open hole is spaced away from the convex curved part and has a second diameter that is larger than the first diameter.

5. A terminal-attached substrate comprising:

a substrate having a through-hole; and a press-fit terminal fitted by pressing to the through-hole, wherein the press-fit terminal includes a pair of press fitting parts that are positioned facing each other in a direction orthogonal to an insertion direction into the through-hole of the substrate while an axial center along the insertion direction is interposed between the pair of press fitting parts and that are fitted by pressing into the through-hole in the insertion direction, a compliant part positioned between the pair of press fitting parts and having an open hole that allows the pair of press fitting parts to deform inward in the orthogonal direction, and a base end part adjacent to the compliant part, the compliant part includes a rigid body part that is positioned at a base end opposite to a leading end side of the open hole in the insertion direction such that the pair of press fitting parts intersect each other at an end part of the rigid body part, the rigid body part includes, on an outer surface in the orthogonal direction, a curved concave part formed in a concave curve toward the axial center, a space due to the curved concave part is formed between an inner peripheral surface of the through-hole of the substrate and the outer surface of the rigid body part, the pair of press fitting parts have inner wall surfaces, respectively, positioned on the open hole in the orthogonal direction and facing each other, each of the inner wall surfaces includes, at the end part of the rigid body part in the insertion direction, a curved convex part formed in a convex curve toward the axial center, the curved concave part and the curved convex part overlap each other in the orthogonal direction at the base end, the through-hole has a dimension measured in the orthogonal direction, the base end part is located outside the through-hole, extends along a length in the insertion direction, has a width measured in the orthogonal direction that is constant along the length, and the constant width of the base end part is less than the dimension of the through-hole measured in the orthogonal direction.

6. The terminal-attached substrate according to claim 5, wherein the rigid body part includes a pair of leading end side parts located where the base end and the open hole are formed, and the curved concave part and the convex curve overlap each other along the pair of leading end side parts of the rigid body part.

7. The terminal-attached substrate according to claim 5, wherein the base end has a base end part that extends in the insertion direction and has a first width dimension, the rigid body part is adjacent to the base end part and the rigid body part has a second width dimension, and the second width dimension is greater than the first width dimension.

8. The terminal-attached substrate according to claim 5, wherein the open hole includes a base end side that is adjacent to the convex curved part and has a first diameter, the leading end side of the open hole is spaced away from the convex curved part and has a second diameter that is larger than the first diameter.

* * * * *